US005591062A

United States Patent [19]

Hettinger

[11] Patent Number: 5,591,062

[45] Date of Patent: Jan. 7, 1997

[54] SPINNING TOY

[76] Inventor: Catherine A. Hettinger, P.O. Box 536564, Orlando, Fla. 32853

[21] Appl. No.: 68,569

[22] Filed: May 28, 1993

Related U.S. Application Data

[63] Continuation-in-part of Ser. No. 833,396, Feb. 10, 1992, abandoned.

[51] Int. Cl.[6] ..... A63H 27/00; A63H 1/02

[52] U.S. Cl. ..... 446/46; 446/240

[58] Field of Search ..... 446/46, 47, 48, 446/236, 238, 239, 240, 255, 256, 396; 273/424

[56] References Cited

U.S. PATENT DOCUMENTS

| | | | |
|---|---|---|---|
| D. 158,908 | 6/1950 | Sullivan | 446/243 X |
| 476,825 | 6/1892 | Schwartz | 446/240 |
| 537,887 | 4/1895 | Bradley | 446/243 |
| 1,393,148 | 10/1921 | MacQuarrie | 446/244 X |
| 1,404,132 | 1/1922 | Manes | 446/46 X |
| 1,454,127 | 5/1923 | McLean et al. | 446/244 |
| 2,098,168 | 11/1937 | Sperry | 446/46 X |
| 3,673,731 | 7/1972 | Farhi et al. | 446/46 |
| 3,710,505 | 1/1973 | Linenfelser | 446/46 |
| 3,859,748 | 1/1975 | Blue | 446/236 |
| 3,959,989 | 6/1976 | Bhandia | 446/244 X |
| 4,077,155 | 3/1978 | Bruntmyer | 446/46 |
| 4,212,131 | 7/1980 | Ross, Jr. | 273/424 X |
| 4,302,901 | 12/1981 | Psyras | 273/424 X |
| 4,356,660 | 11/1982 | O'Brien | 446/46 |
| 4,631,848 | 12/1986 | Isawa et al. | 446/243 X |
| 4,737,128 | 4/1988 | Moormann et al. | 446/46 |
| 4,889,347 | 12/1989 | Mineart | 273/424 |
| 4,919,083 | 4/1990 | Axelrod | 446/46 X |
| 5,076,923 | 11/1991 | De Bourbon | 446/236 |
| 5,125,862 | 6/1992 | Paranto | 446/236 X |

FOREIGN PATENT DOCUMENTS

| | | | |
|---|---|---|---|
| 419469 | 10/1925 | Germany | 446/243 |
| 3292 | of 1912 | United Kingdom | 446/243 |
| 1499994 | 2/1978 | United Kingdom | 446/240 |
| 2187969 | 9/1987 | United Kingdom | 446/46 |

*Primary Examiner*—Robert A. Hafer
*Assistant Examiner*—D. Neal Muir

[57] ABSTRACT

A toy device which includes a center dome structure and a skirt is used as a spinning toy. It is designed to be spun on the finger to provide enjoyment and entertainment for adults and children.

11 Claims, 3 Drawing Sheets

SPINNING TOY

This application is a continuation-in-part of Ser. No. 07/833,396, filed Feb. 10, 1992, now abandoned.

BACKGROUND OF THE INVENTION

1. Field of the Invention

The present invention relates to amusing toys and more particularly to a toy which is spun on the finger for the amusement of children and adults.

2. Prior Art

Many people are desirous of a simple diversion when they are caught in traffic or would like something to do with their hands. Sports are out Of the question in the car or inside the house. It is normal and natural to want to move or fidget. People who are quitting smoking often desire something to use to occupy themselves. Presently, there are no devices which fit this criteria that can provide the pleasant sensation of spinning that this toy can.

SUMMARY OF THE INVENTION

The principal object of the present invention is to provide a novel device which is simple and easy to use which serves as a pleasant diversion to the user.

Another object is to provide a toy which can be used for the pleasure of children.

A further object of this invention is to provide a means to stop smoking by giving the user something to do with his hands.

The foregoing objects and others that are apparent are achieved through the use of a spinning toy.

The user of this toy places the toy on the finger and starts it spinning with the other hand. A small change of movement keeps the toy spinning endlessly.

The preferred embodiment has a dome which fits over the finger and a skirt for rotational balance.

Alternately, a stick such as but not limited to a rod, pencil or pen can be used under the toy instead of the finger.

The features and advantages of the present invention will become apparent from the following detailed description of the invention when read with the accompanying drawings.

DETAILED DESCRIPTION OF PREFERRED EMBODIMENTS

Figure 1:
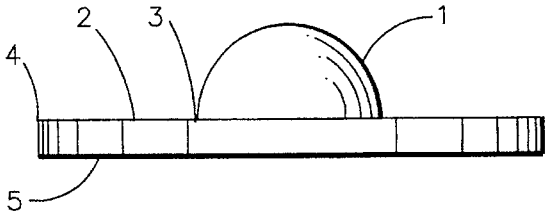
FIG. 1 is the side view of the most preferred embodiment.

Referring specifically to FIG. 1, there is illustrated the most preferred embodiment of the novel spinning toy. It is formed from a primary sheet of plastic material no more than 1/32 of an inch thick molded to form a central area (1), a thin walled finger placement dome area of sufficient width and depth to provide room for initial eccentric rotation with the rotation centered along the entire inner wall. Providing rotational balance is a skirt balance area(2) which is divided from the dome area by a step demarcation section/inner joint (3) where the area joins the skirt balance means (2) and aids a user in retaining a finger in said area during spinning. The skirt balance area (2)formed from the sheet radially outward from said inner joint (3) to balance said spinner during use provides sufficient mass to aid in maintaining a spin during use. It is composed of an outer joint (4) depending outward extending the skid balance area and a tip (5) extending radially downward from said outer joint (4).

Figure 3:
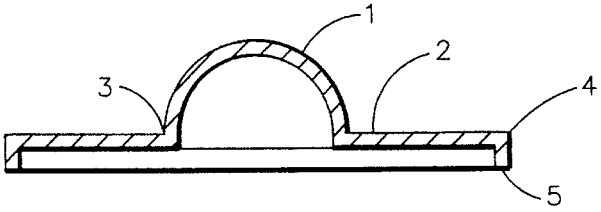
FIG. 3 is a sectional view of the most preferred embodiment which bisects the unit at A—A of FIG. 2.
Figure 2:
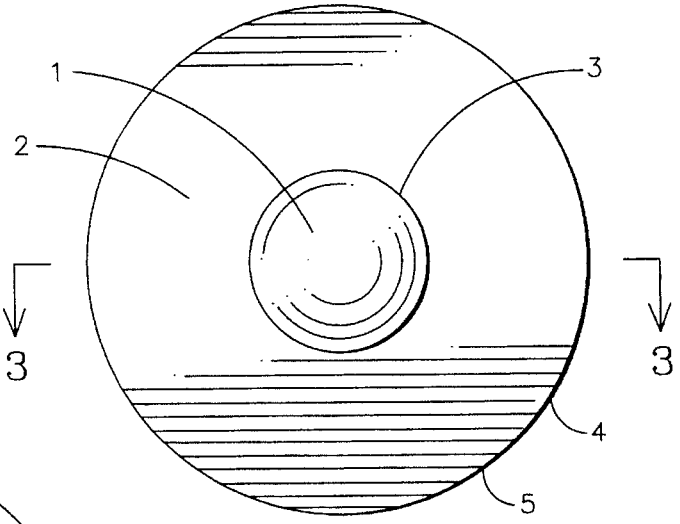
FIG. 2 is a top plan view of the most preferred embodiment.

A further embodiment is in appearance the same as in FIGS. 1, 2, and 3. However, it is molded using injection or blow molded or cut from a block. Here the central dome area(1) appears the same and the skirt balance area is essentially planar (2).

A further embodiment uses the toy similarly but a stick, rod, or pen can be used in place of the finger.

Figure 4:
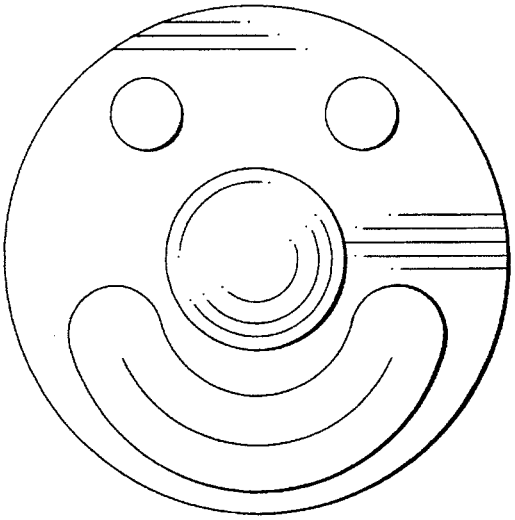
FIG. 4 is a top view of a decorated version of the preferred embodiment with a clown face.
Figure 5:
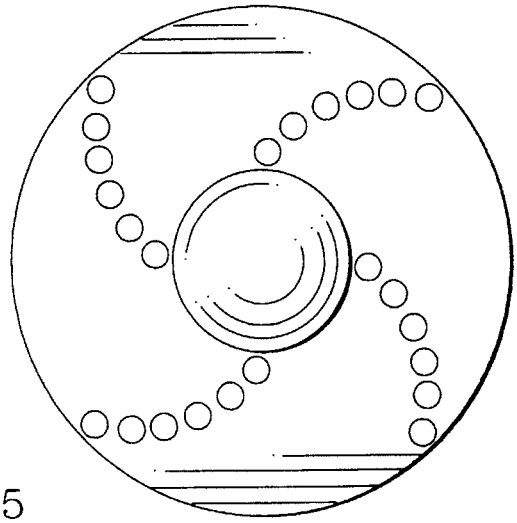
FIG. 5 is a top plan view of a decorated version showing dots.
Figure 6:
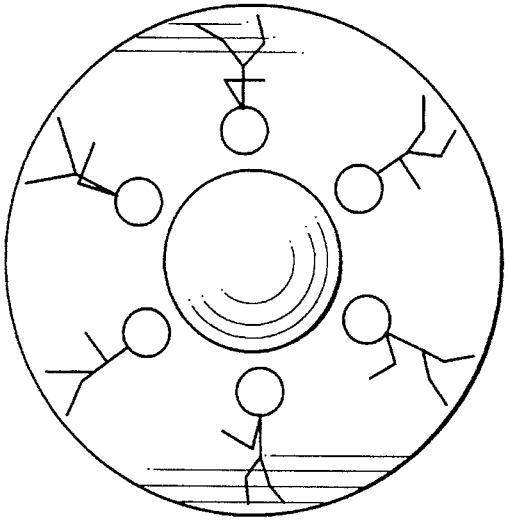
FIG. 6 is a top plan view of a decorated version showing figures.

Referring to FIGS. 4, 5, and 6, there is represented three illustrations which are added to the preferred main embodiment. FIG. 4 is a top down view showing a clown face with the central dome area for a nose. These are painted on. FIG. 5 is an illustration of dots which are added by stickers or paint or printed which are in lines forming spirals. The dots appear to be solid spirals when the toy is spun. FIG. 6 shows a series of figures on the skirt balance area in various stages of movement. Spinning the toy provides animation to the figures.

Figure 7:
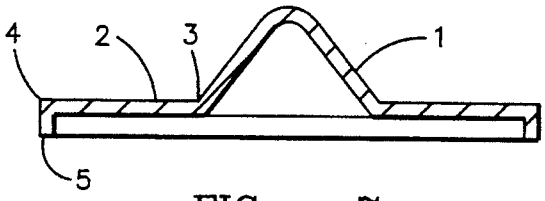
FIG. 7 is a sectional view of another preferred embodiment.
Figure 8:
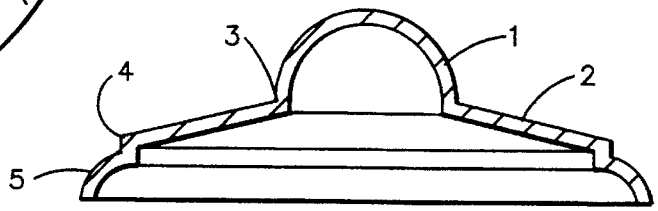
FIG. 8 is a sectional view of another preferred embodiment.
Figure 9:
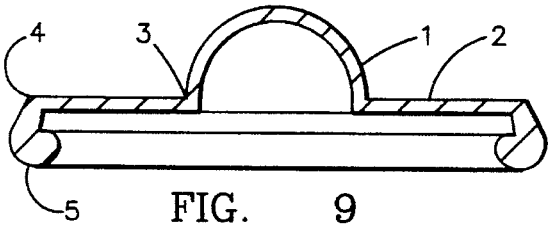
FIG. 9 is a sectional view of another preferred embodiment.

Referring to FIGS. 7, 8, and 9, these are different embodiments of this invention. They may be formed from a sheet, injection or blowmolded or sculpted from a solid block. FIG. 7 has a cone shaped area in the center(1). FIG. 8 has a different angle at joint,(3), and a more gradual edge with tip (5)and outer joint (4). FIG. 9 is formed by injection molding. Tip (5) is a rounded tip and outer joint (4)is safely angled. This makes the toy safer for users to touch the edges.

Figure 11:
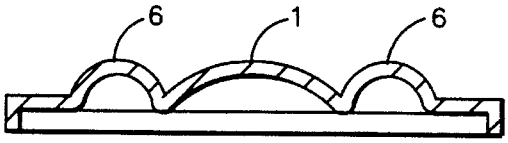
FIG. 11 is a sectional view of a molded design taken at B—B of molded design of FIG. 10.
Figure 10:
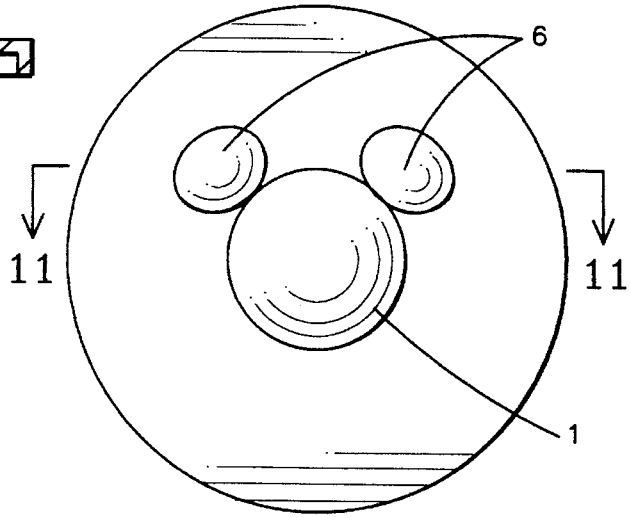
FIG. 10 is a top view of a molded design of a further preferred embodiment.
Figure 12:
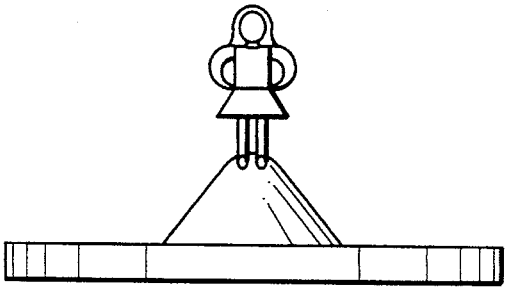
FIG. 12 is a sectional view of a molded design of a further preferred embodiment with a design on top of the central area.
Figure 15:
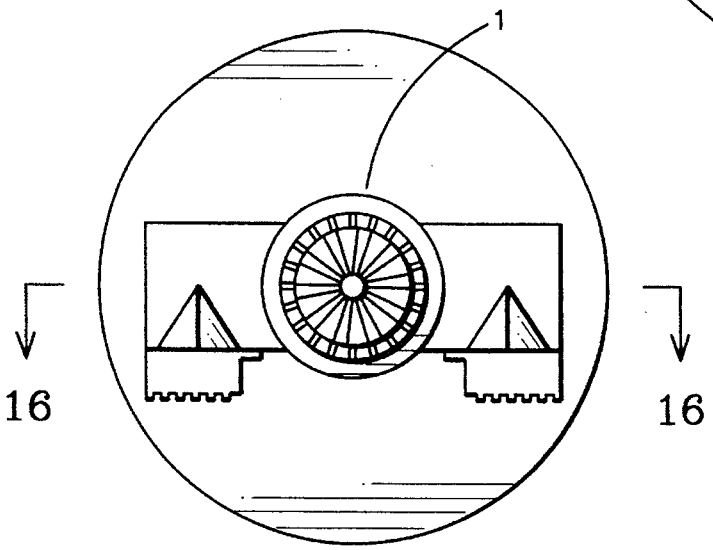
FIG. 15 is a top plan view of a molded design of the U.S. Capitol.
Figure 16:
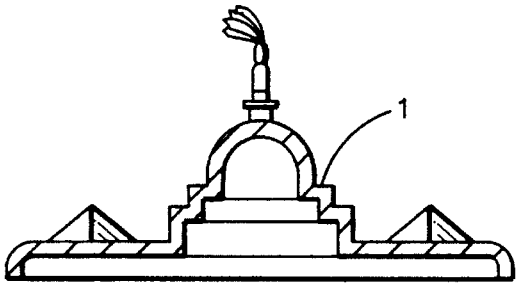
FIG. 16 is a sectional view taken at C—C of FIG. 15.

FIGS. 10, 11, 12, 15 and 16 represent three dimensional embellishments to the design. Referring to FIGS. 10 and 11, area (1)is the domed area of the preferred embodiment(the face) and the two areas (6) are ears which are half ellipsoid spheres added on the top. FIG. 11 is a sectional view taken at B—B of FIG. 10. FIG. 12 is a bisected vertical section of a version which shows a figure on the top. It can be added with a fastener or glue or injection molded directly when the toy is made. FIGS. 15 and 16 have domes area (1) which is formed to be the dome of the U.S. Capitol. The molded areas (6), are the legislative wings. FIG. 16 is a sectional view taken at C—C of FIG. 15.

Figure 13:
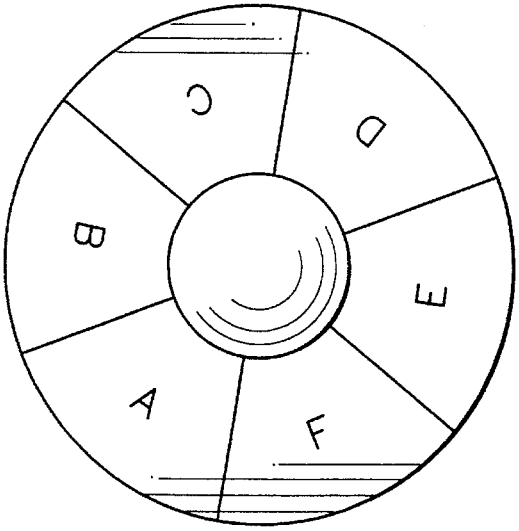
FIG. 13 is a view of the bottom of an alternate embodiment showing letters.

FIG. 13 is an alternate spinning toy which is made into dice. One player spins while another turns his head away and grabs the spinning toy. The area illustrated is the underneath side. When the player turns it over a location, A,B,C,D,E,F denotes the character which has been picked. These are painted, printed, or added on as stickers. With a dice game the areas are 1,2,3,4,5,6, with dots used to represent the numbers. With a different version, there are only three different areas, one with scissors, one with paper and one with stone. In the use for a Dreidel game the area is divided into four Hebrew letters.

Figure 14:
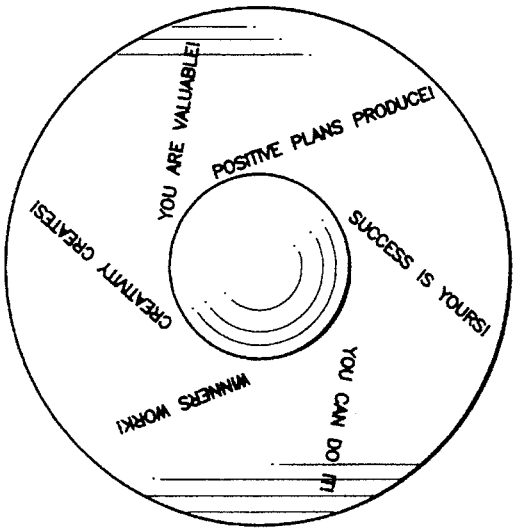
FIG. 14 is a view of an embodiment showing written messages.

FIG. 14 shows a view of typed messages. When the toy is stationary they can be read directly. When the toy is spun the message becomes "subliminal". The brain can retain it without the conscious being aware of it.

Figure 17:
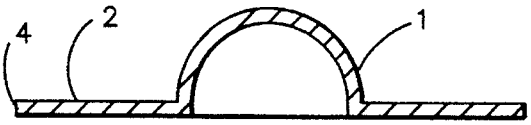
FIG. 17 is a sectional view bisected in the middle of a embodiment molded out of soft plastic.

FIG. 17 shows a view of a molded design made of soft spongelike material. It can be thick because it is soft and lightweight. It need not have an outer joint but only an abrupt edge(4). Because it is so soft, this makes a safe toy to spin.

While preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

I claim:

1. A finger spinner comprising:

a thin, round, single thickness, primary sheet of plastic material molded to form a unitized central finger placement area means and a skirt balance means, said central finger placement area means being a thin walled essentially spherical dome and a step demarcation joint where the central finger placement area means joins said skirt balance means extending radially outward from said step demarcation joint in an essentially flat plane so that said step demarcation joint aids a user in maintaining a finger in said central finger placment area means during spinning, said thin walled essentially spherical dome having a radiused apex continuing to said step demarcation joint, said skirt balance means providing a mass to balance said finger spinner to aid a user in keeping a finger in a stable spinning spot under said thin walled essentially spherical dome, said skirt balance means formed from said sheet radially outward from said step demarcation joint to balance said spinner during use and providing sufficient mass to aid in maintaining a spin during use, said skirt balance means further comprising a circular outer edge means depending downward and thereby comprising a bottom edge.

2. A finger spinner comprising:

a unitized central finger placement area means and a skirt balance means, said central finger placement area means having a thin walled essentially spherical dome and a step demarcation section joint where the central finger placement area means joins said skirt balance means extending radially outward from said step demarcation joint, in essentially a flat plane, so that said step demarcation joint aids a user in maintaining a finger in said central finger placement area means during spinning, said thin walled essentially spherical dome having a radiused apex continuing to said step demarcation joint, said skirt balance means providing a mass to balance said finger spinner to aid a user in keeping a finger in a stable spinning spot under said thin walled essentially spherical dome, said skirt balance means essentially planar in shape formed radially outward from said step demarcation joint to balance said spinner and providing sufficient mass to aid in maintaining a spin during use, said skirt balance means further comprising a circular outer edge means depending downward comprising a bottom edge.

3. A finger spinner in accordance with claim 1 which is formed from a plastic sheet no more than 1/32 of an inch thick whereby a safe toy is provided which is too light to cause injury.

4. A finger spinner in accordance with claim 1 which has illustrations on it from the group consisting of painting, printing and stickers.

5. A finger spinner in accordance with claim 2 which is made by injection molding and has depending downward said bottom edge which is rounded and safely angled, whereby the finger spinner is safer to handle by avoiding sharp edges.

6. A finger spinner in accordance with claim 1 which has a molded face on it comprising:

the thin-walled dome area resembles a face by the addition of two half ellipsoid spheres placed at one side of said thin-walled essentially spherical dome such that they form the appearance of a head with ears.

7. A finger spinner in accordance with claim 2 comprising: attached to the radiused apex of the thin walled dome, a figurine.

8. A finger spinner in accordance with claim 2 which comprises a central finger placement area means molded to resemble the dome of the U.S. Capitol and elevated areas on either side to illustrate the legislative wings of the U.S. Capitol.

9. A finger spinner in accordance with claim 2 where the underside, that is the side wherein the finger is inserted, has been divided into equal areas similar to dice, where designs which are added from the group consisting of painting, printing and stickers.

10. A finger spinner in accordance with claim 1 further including a series of typed messages.

11. A finger spinner in accordance with claim 2 which is comprises of soft spongelike material that is soft and lightweight comprising a skirt balance means that essentially ends at a circular outer edge, whereby a safe finger spinner is made.

* * * * *